US005588412A

United States Patent [19]

Nozaki

[11] Patent Number: 5,588,412

[45] Date of Patent: Dec. 31, 1996

[54] VARIABLE INJECTION HOLE TYPE FUEL INJECTION NOZZLE

[75] Inventor: Shinya Nozaki, Saitama, Japan

[73] Assignee: Zexel Corporation, Tokyo, Japan

[21] Appl. No.: 562,168

[22] Filed: Nov. 22, 1995

[30] Foreign Application Priority Data

Nov. 25, 1994 [JP] Japan ..... 6-314338

[51] Int. Cl.[6] ..... F02M 37/04

[52] U.S. Cl. ..... 123/496; 123/446

[58] Field of Search ..... 123/496, 299, 123/300, 585, 590, 446; 239/533.12

[56] References Cited

U.S. PATENT DOCUMENTS

| | | | |
|---|---|---|---|
| 2,003,814 | 6/1935 | Taylor . | |
| 4,658,824 | 4/1987 | Scheibe | 123/472 |
| 4,736,712 | 4/1988 | Savkar | 123/299 |
| 5,020,500 | 6/1991 | Kelly | 123/496 |
| 5,156,132 | 10/1992 | Iwanaba | 123/496 |
| 5,163,397 | 11/1992 | Pien | 123/299 |
| 5,484,104 | 1/1996 | Kukler | 123/496 |

FOREIGN PATENT DOCUMENTS

| | | | |
|---|---|---|---|
| 902455 | 8/1945 | France | 123/299 |
| 2408043 | 6/1979 | France . | |
| 2752640 | 5/1979 | Germany . | |
| 60-36772 | 2/1985 | Japan . | |
| 610873 | 4/1946 | United Kingdom . | |

OTHER PUBLICATIONS

Patent Abstracts of Japan, vol. 8, No. 201, (M–325), 14 Sep. 1984 & JP–A–59 090765, May 1984.

*Primary Examiner*—Carl S. Miller

*Attorney, Agent, or Firm*—Pearne, Gordon, McCoy & Granger

[57] ABSTRACT

A nozzle is provided wherein the operation of injection hole groups is switched from one to another in accordance with the axial displacement of a spool valve. A nozzle body has a bottomed hole, and a plurality of injection hole groups are provided at different circumferential levels in the side wall of the bottomed hole, the injection holes at different circumferential levels being different in diameter from each other. The valve portion of the spool valve is urged by a spring so that the lower end of the valve portion abuts against the base of the bottomed hole in the normal condition. Moreover, a fuel passage communicates with one of the injection hole groups in the normal condition and communicates with the other injection hole group at a position where the valve portion is displaced axially against the spring force on receiving the pressure of pressurized fuel. In addition, braking means is used to fixedly hold both the axial positions of the spool valve, depending on the operating condition of an engine.

7 Claims, 5 Drawing Sheets

VARIABLE INJECTION HOLE TYPE FUEL INJECTION NOZZLE

BACKGROUND OF THE INVENTION

1. Field of the Invention

The present invention relates to a fuel injection nozzle and more particularly to a variable injection hole type fuel injection nozzle.

2. Description of the Related Art

Extreme importance has been directed to NOx reduction in the low-speed, light-load region and to smoke reduction in the high-load region of a diesel engine. In order to cope with the former, it is preferred to reduce the initial injection rate by effecting fuel injection for a good length of time using small-diameter injection holes and to establish optimum burning condition by accelerating fuel atomization, whereas in order to solve the latter, it is preferred to effect fuel injection for a short time using large-diameter injection holes.

However, conventional fuel injection nozzles of the sort referred to above make it impossible to deal with the problems that have been posed so far.

In order to take steps to deal with the aforementioned problems, there has been proposed a variable injection nozzle designed for the injection hole area to be made variable and for the injection hole to be made switchable as desired by means of an actuator. An injection nozzle of such a type that has been proposed in Japanese Patent Unexamined Publication No. Sho 60-36772 is of such a translation type that injection holes are controlled by moving a valve in the axial direction.

In this prior art, a first and a second injection hole group are provided at different levels in the hole wall in the leading end portion of a nozzle body, whereas a through-hole is formed on the axial line of the hole of the nozzle body. Moreover, a spool valve formed with a land is inserted through the through-hole so as to make a rod portion face the position of the second injection hole group, and the spool valve is moved axially by an actuator (electromagnetic solenoid) provided above the nozzle body.

However, there arises a problem from the aforementioned construction in that because the lower end of the spool valve is made a surface where the internal pressure of the engine is received, control force great enough to hold the position of the spool valve against the shaft power due to the pressure in the engine cylinder is needed. Consequently, not only the spring and the actuator but also the injection nozzle tend to become large-sized.

Another problem inherent in the prior art is that since the edge face of the spool valve is exposed in the engine cylinder, seizing at high temperatures due to the burning of the fuel in the cylinder occurs or stable operation is easily ruined as free carbon sticks and accumulates.

While the diameters of the injection holes in the first and second prior art injection hole groups are made equal, fuel is jetted from the first injection hole group when the needle valve is opened and the second injection hole group is also opened via the rod portion at the time the actuator and the spool valve are lifted so as to jet the fuel from both the first and second injection hole groups. As a result, the first injection hole group is always kept open at the time of low and high loads, the problem in this case is that since the plurality of injection hole groups are uncontrollable individually it is impossible to make the diameters of the injection holes variable so as to effect optimum atomization.

SUMMARY OF THE INVENTION

The present invention has been made to solve the foregoing problems, and an object of the invention is to provide a variable injection hole type fuel injection nozzle designed so that means for controlling the position of a spool valve is small-sized and that the operation of the spool valve is made smooth to ensure that fuel injection to be carried out by a plurality of injection hole groups can be controlled individually as desired.

In order to solve the object above, a variable injection hole type fuel injection nozzle according to the present invention comprises:

a nozzle body having a bottomed hole for guiding pressurized fuel to the leading end portion of a nozzle needle below its seat portion, a plurality of injection hole groups being provided at axially different circumferential levels in the side wall of the bottomed hole, the injection holes at different circumferential levels being different in diameter from each other;

a spool valve which is provided with a valve portion which passes through the axial center of the nozzle needle and whose leading end portion is fitted into the bottomed hole; which is urged by a spring so that the lower end of the valve portion abuts against the base of the bottomed hole in the normal condition, and which is provided with a fuel passage located in the valve portion, the fuel passage communicating with one of the injection hole groups at that location and communicating with the other injection hole group at a position where the valve portion is displaced axially against the spring force on receiving the pressure of the pressurized fuel; and braking means which is arranged in the upper region of the spool valve and securely holds both the axial positions of the spool valve.

According to the present invention, the plurality of injection hole groups provided at axially different circumferential levels in the side wall of the bottomed hole are such that the diameters of the injection holes at the same circumferential level are set equal and those of the injection holes at different circumferential levels are made different. The spool valve is urged by the spring on the upper side up to a position (descent position) to abut against the hole base in the normal condition, when the fuel passage radially extending from the axial center at the above position communicates with one of the injection hole groups. The spool valve is displaced axially on receiving the pressure of the pressurized fuel when the nozzle needle is opened, and the fuel passage communicates with the other injection hole group at that position (ascent position).

However, the spool valve is forced to remain at the axial position during the operation of the engine, for example, at the time of low-speed, light-load and high-speed, heavy-load.

While the diameters of the injection holes in the lower group are set small, whereas those of the injection holes in the upper group are set large, the spool valve is not lifted by the fuel pressure when the braking means is operated during the operation of the engine at the time of low speed and light load, so that the spool valve is held at the descent position. Then the upper injection hole group is kept closed with the peripheral face of the spool valve, whereby the pressurized fuel is injected from only the lower injection hole group including the small-diameter injection holes. Suitably atomized fuel injection can thus be carried out.

During the operation of the engine at the time of high-speed, heavy-load, moreover, the spool valve is held at the upper position by operating the braking means when the fuel pressure causes the spool valve to be lifted. Then the lower injection hole group is closed with the peripheral face of the spool valve, whereby the fuel passage communicates with only the upper injection hole group including the large-diameter injection holes. A quantity of pressurized fuel is thus injected by the upper injection hole group including the large-diameter injection holes.

The spool valve only abuts against the hole base or moves upward and is not exposed in the combustion chamber of the engine. Therefore, no seizing due to high temperatures occurs and the aforesaid displacement of the axial position is smoothly effected to ensure that the injection-hole switching injection can be carried out stably for a long time.

Moreover, the injection pressure and the spring force are utilized as the force of moving up and down the spool valve, respectively. Since the one injection hole group is to be switched to the other injection hole group by braking the movement of the spool valve, control of their positions is facilitated. Moreover, the movement and position holding of the spool valve are less affected by the axially-directed force caused by the pressure in the engine cylinder as the spool valve is not passed through the hole in the axial direction. Therefore, the position of the spool valve is made controllable by small-sized electrical and mechanical elements and besides the fuel injection nozzle is prevented from becoming large-sized.

BRIEF DESCRIPTION OF THE DRAWINGS

The above and other objects and features of the present invention will be more apparent from the following description taken in conjunction with the accompanying drawings.

FIGS. 2A and 2B are enlarged views showing the leading end portion of the nozzle according to the embodiment of the invention, in which FIG. 2A shows the spool valve at the descent position, and FIG. 2B shows the spool valve at the ascent position;

DETAILED DESCRIPTION OF THE PREFERRED EMBODIMENTS

A description will subsequently be given of an embodiment of the present invention by reference to the attached drawings.

FIGS. 1 to 6 inclusive, show a variable injection hole type fuel injection nozzle embodying the present invention.

Figure 1:
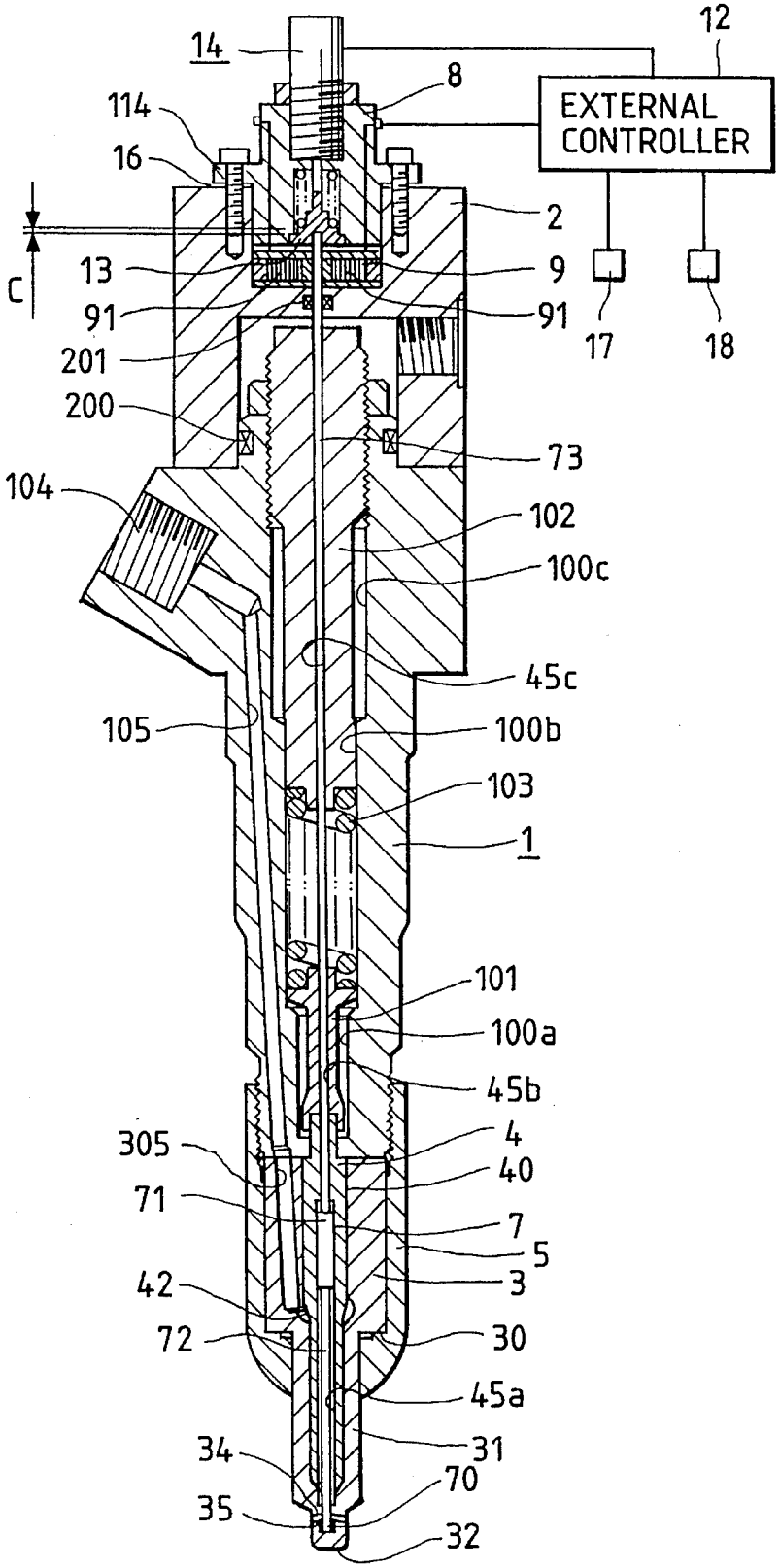
FIG. 1 is a vertical sectional side view showing a variable injection hole type fuel injection nozzle according to an embodiment of the present invention.

In FIG. 1, reference numeral 1 designates a nozzle holder body; 2, a head cover securely and oil-tightly fitted via an O-ring 200 to the upper end portion of the nozzle holder body 1; 3, a nozzle body coupled by a retaining nut 5 to the nozzle holder body 1; and 4, a nozzle needle internally fitted to the nozzle body 3.

A first to a third hole 100*a* to 100*c* are vertically bored through the axial center of the nozzle holder body 1, the diameters of these holes being gradually enlarged from the lower end up to the upper end of the nozzle holder body 1. Moreover, a push rod 101 is slidably fitted in an area between the first and second holes 100*a* , 100*b*. Further, an adjusting screw 102 which is screwed into the internal thread of the third hole 100*c* is fitted in an area between the third and second holes 100*c*, 100*b*, and a nozzle spring 103 is held between the adjusting screw 102 and the push rod 101.

The nozzle body 3 has a stepped part 30 mating with the box hole base of the retaining nut 5 in the longitudinal mid-portion of the outer face of the nozzle body 3, which also has a main portion 31 extending through the retaining nut 5 under the stepped part 30. In addition, a small-diameter injection hole part 32 is formed via a tapered part at the leading end of the main portion 31.

Figure 2A:
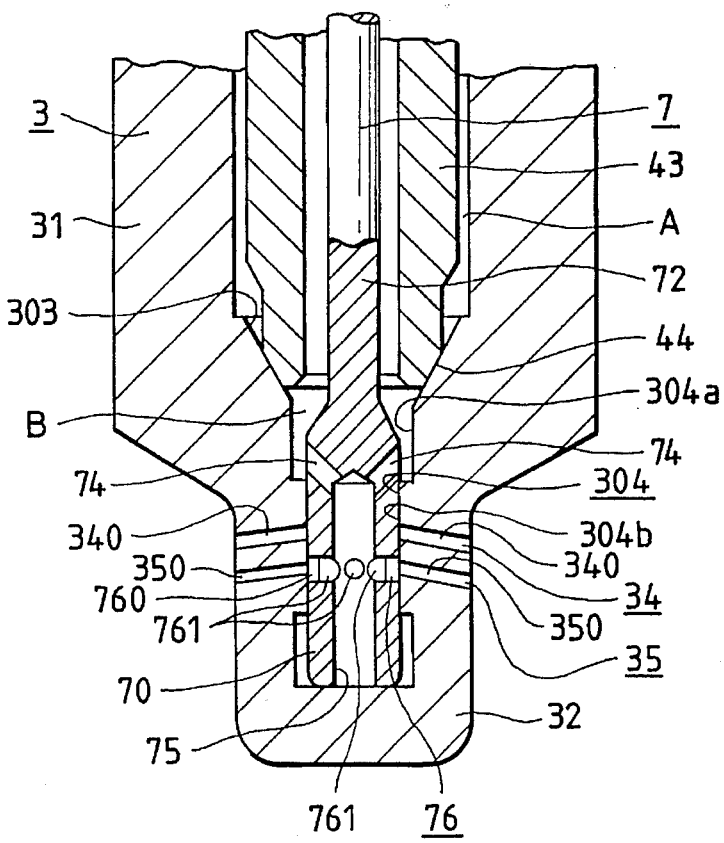
Figure 2B:
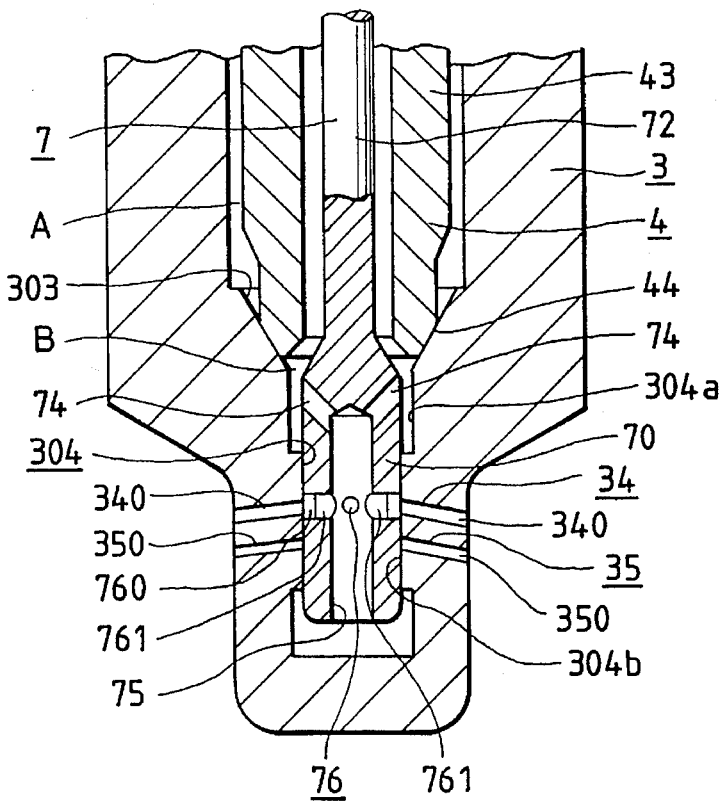
Figure 3:
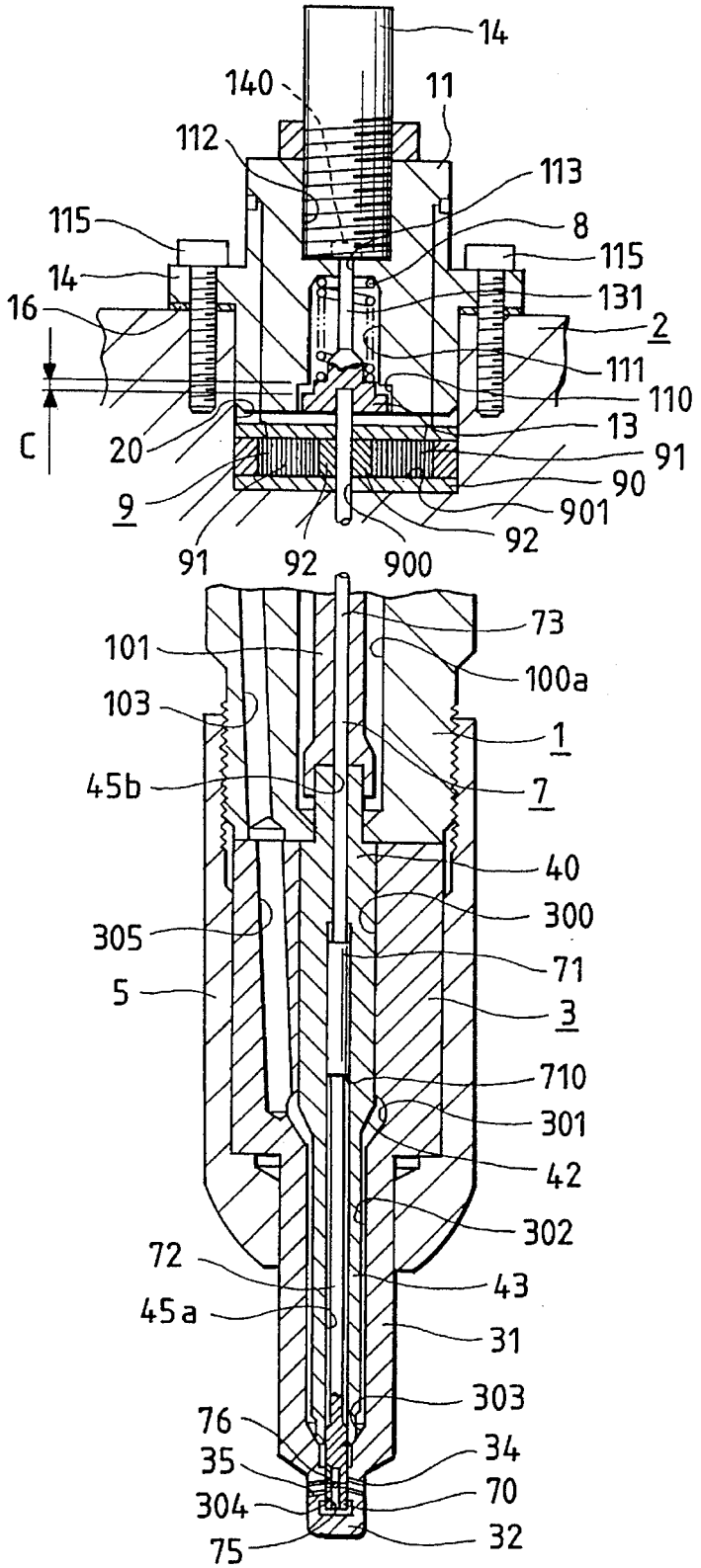
FIG. 3 is a sectional view illustrative of the lower injection hole group performing the injecting operation with the omission of the intermediate section according to the embodiment of the invention.
Figure 4:
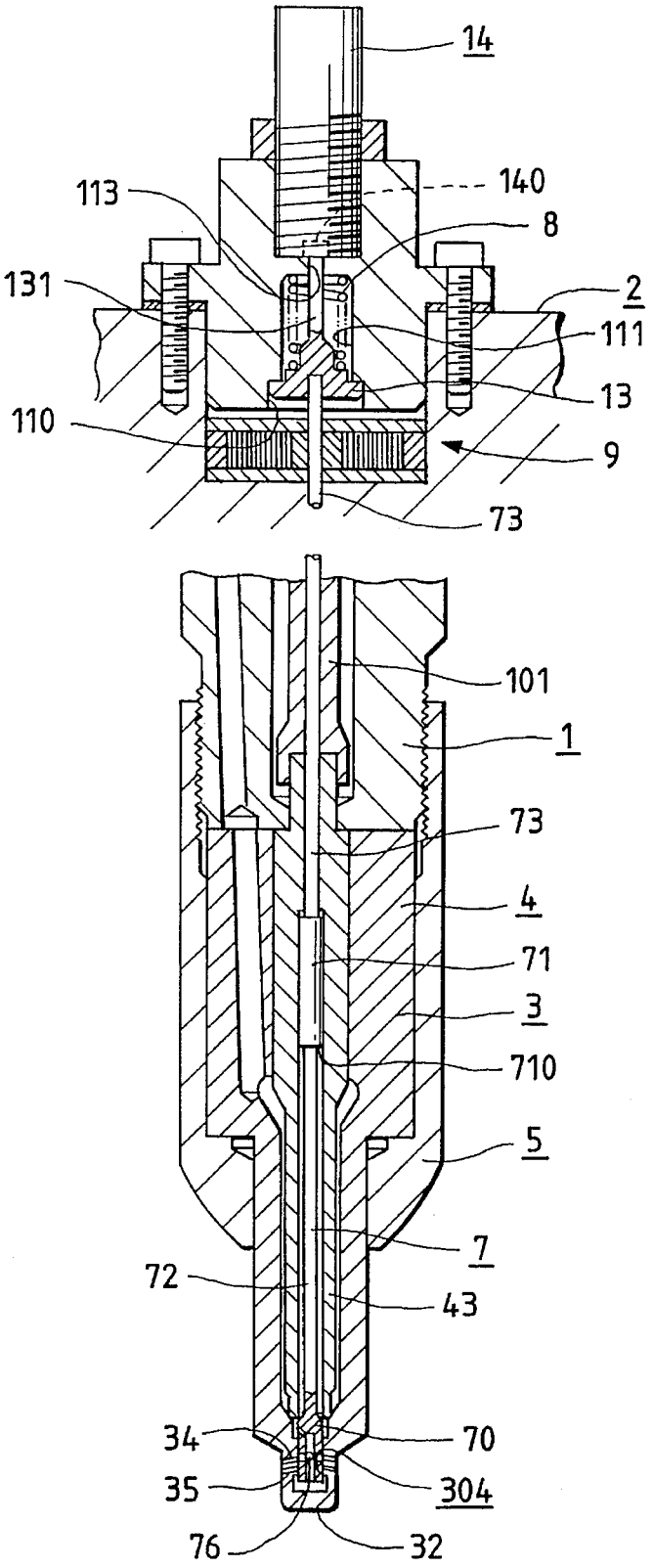
FIG. 4 is a sectional view illustrative of the upper injection hole group performing the injecting operation with the omission of the intermediate section according to the embodiment of the invention.

On the other hand, a guide hole 300 coaxial with the first hole 100*a* of the nozzle holder body 1, and an oil reservoir 301 greater in diameter than the guide hole 300 are formed in the axial center of and from the upper end to the lower end of the nozzle body 3 as shown in FIGS. 3 and 4. Further, a leading hole 302 relatively smaller in diameter than the guide hole 300 is bored under the oil reservoir 301. Further, a conical seat face 303 is formed at the lower end of the leading hole 302 as shown in FIG. 2A and 2B. Still further, a bottomed hole 304 through which pressurized fuel is guided is formed continuously with respect to the seat face 303.

The bottomed hole 304 has a large-diameter hole 304*a* and a shaft hole 304*b* whose diameter is relatively smaller than of the former.

A pressurized fuel port 104 to be connected to an inlet connector is provided on one side of the nozzle holder body 1 and communicates with the oil reservoir 301 via the nozzle holder body 1 and passage holes 105, 305 bored in the nozzle body 3, so that pressurized fuel is guided to the oil reservoir.

The upper end of the nozzle needle 4 is coupled to the push rod 101, whereas a guide portion 40 slidable on the guide hole 300 is fitted to the outer periphery of the nozzle needle 4. Further, a tapered pressure receiving part 42 for receiving fuel pressure in the oil reservoir 301 is provided at the end of the guide portion 40, and a small-diameter shaft portion 43 for use in forming a tubular fuel passage A is provided from beneath the pressure receiving part 42 with respect to the leading hole 302 as shown in FIG. 2A and 2B. A conical seat face 44 to be attached to and detached from the seat face 303 is also formed at the lower end of the small-diameter shaft portion 43.

A plurality of injection hole groups communicating with the shaft hole 304*b* are disposed at a plurality of circumferential levels of the side wall of the injection hole part 32 surrounding the shaft hole 304*b* of the bottomed hole 304.

According to this embodiment of the invention, as shown in FIG. 2A and 2B, there are an upper injection hole group 34 bored at a circumferential level in an area relatively close to the base of the injection hole part, and a lower injection hole group 35 bored at another circumferential level in an area separated axially from the upper injection hole group 34. The upper and lower injection hole groups 34 and 35 include a plurality of injection holes 340 and 350 which are each bored at equal intervals.

The upper and lower injection hole groups 34 and 35 are adequately sloped down with respect to a line segment perpendicular to the respective nozzle axial lines, and the upper and lower injection holes 340 and 350 have the same diameter at the levels to which these injection holes belong, respectively. However, the diameters of the upper and lower injection hole groups 34 and 35 differ from one another. Given that the diameter of each upper injection hole 34 of the upper injection hole group 304 is d1; and that of each lower injection hole 35 of the lower injection hole group, d2; their mutual relationship is defined by d1>d2.

A spool valve 7 for controlling the closing motion of the upper and lower injection holes 34 and 35 are arranged in the axial center ranging from the bottomed hole 304 up to the head cover 2.

More specifically, as shown in FIG. 3, a first hole 45*a* is formed from the lower end up to the middle position of the axial center of the nozzle needle 4; a second hole 45*b* relatively smaller in diameter than the first hole 45*a* is formed from the lower end of the first hole 45*a* up to the upper end of the push rod 101; and a third hole 45*c* coaxial with and equal in diameter to the second hole 45*b* is formed in the adjusting screw 102.

The spool valve 7 is provided with a valve portion 70 precisely fitted into the shaft hole 304*b* of the closed hole 304 in such a manner as to be axially movable therein, the valve portion being located in an area running through the nozzle needle 4 and extending downward. The spool valve 7 is equipped with an intermediate large-diameter portion 71 precisely fitted into the first hole 45*a* of the nozzle needle 4 in such a way as to be axially movable therein, the intermediate portion being located a predetermined distance apart from the valve portion 70.

Further, a small-diameter shaft portion 72 which is sufficiently thinner in diameter than the first hole 45*a* is provided between the intermediate large-diameter portion 71 and the valve portion 70, and a small-diameter portion 73 idly fitting into the first and third holes 45*b* and 45*c* and extending upward from the end of the intermediate large-diameter portion 71.

The intermediate large-diameter portion 71 thus precisely fitted is intended to prevent fuel leakage and to cause its underside 710 to produce the force directed upward on receiving the injection pressure. The small-diameter portion 72 absorbs discrepancy between the axes of the intermediate large-diameter portion 71 and the valve portion 70 by means of elastic deformation in addition to forming a passage for guiding the pressurized fuel to the aforementioned underside 710.

Although it is preferred for the valve portion 70 and the small-diameter portion 72 to be formed integrally with the intermediate large-diameter portion 71, the valve portion 70 and the small-diameter portion 72 may be made separately from the intermediate large-diameter portion 71, if necessary, so as to integrate them in one body by welding, press-fitting and screwing.

The valve portion 70 is long enough to reach the large-diameter hole 304*a* in such a state that its lower edge face is in contact with the base of the shaft hole 304*b*, and an annular fuel passage B communicating with the fuel passage A when the nozzle needle 4 is opened is formed between the outer periphery of the valve portion 70 and the large-diameter hole 304*a*. Further, a plurality of radial holes 74 are provided in the upper end portion of the valve facing the annular fuel passage B, and these radial holes 74 also communicate with an internal fuel passage 7 bored axially in the valve portion.

Therefore, the valve portion 70 is formed into a tube due to the internal fuel passage 75 and besides a fuel passage 76 capable of selectively communicating with the upper and lower fuel hole groups 34 and 35 provided in the injection hole part 32 is formed in the tubular wall.

The fuel passage 76 needs to be placed at a level at which it communicates with the lower injection hole group 35 at a position (descent position) where the lower edge face of the valve portion 70 remains in contact with the shaft hole 304*b*. The fuel passage 76 according to this embodiment of the invention includes one annular groove 760 laterally provided in the outer periphery of the valve portion, and a plurality of radial holes 761 for connecting the annular groove 760 and the internal fuel passage 75. The plurality of radial holes 761 are circumferentially provided at equal intervals. Preferably, the width of the annular groove 760 should be adequately greater than the diameter of any injection hole in the large-diameter injection hole group 34 even though there axially exists a slight error in machining the spool valve 7, so that the annular groove is allowed to communicate with the injection hole group completely during the injecting operation.

The spool valve 7 is urged downward by a spring 8 placed at the head cover 2 to make its upper end portion run through the nozzle holder body 1 so as to effect the landing of the valve portion 70 at the descent position in the normal condition. Moreover, the axial position of the spool valve 7 is detected by a position sensor 14 secured in the head cover and held at that position by a braking means 9 in accordance with the operating condition of an engine.

More specifically, the head cover 2 is provided with a space 21 for enclosing the upper end portion of the adjusting screw 102 in an area including the axial center. On the other hand, a box hole 20 is formed from the upper end of the head cover 2 so as to exclude the intermediate wall, and the braking means 9 is securely fitted by press-fitting to the base of the box hole 20, a stopper 11 being fitted to the upper side of the braking means 9. The small-diameter portion 73 of the spool valve 7 is oil-tightly sealed with an O-ring 201 fitted to the through-hole of the intermediate wall.

A large-diameter hole 110 and a small-diameter hole 111 are coaxially formed from the underside of the stopper 11, whereas a fitting hole 112 is provided from the surface thereof. The fitting hole 112 communicates via a small-diameter hole 113 with the small-diameter hole 111.

The braking means 9 is an electrical•mechanical means for allowing the spool valve 7 to axially move during the time of non-operation and for being forced to hold the axial position during the time of operation. The braking means 9 according to this embodiment of the invention is of a piezoelectric actuator type, though an electromagnet may be used therefor instead.

More specifically, the braking means 9 is equipped with a disc-like casing 90, a pair of laminated piezoelectric elements 91 contained therein, and a pair of press plates 92 each having presser faces corresponding to the profile of the small-diameter portion of the spool valve 7.

Figure 5:
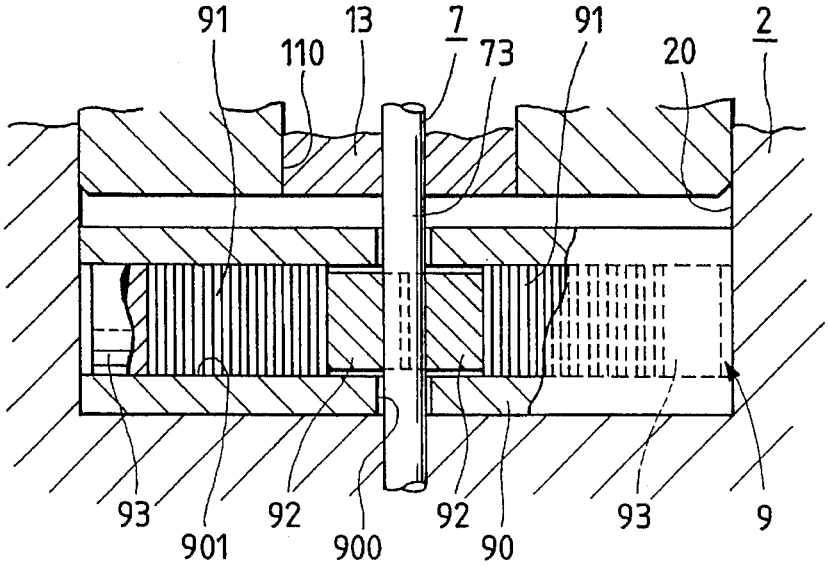
FIG. 5 is a partial cutaway enlarged view showing the braking means in FIG. 1.
Figure 6:
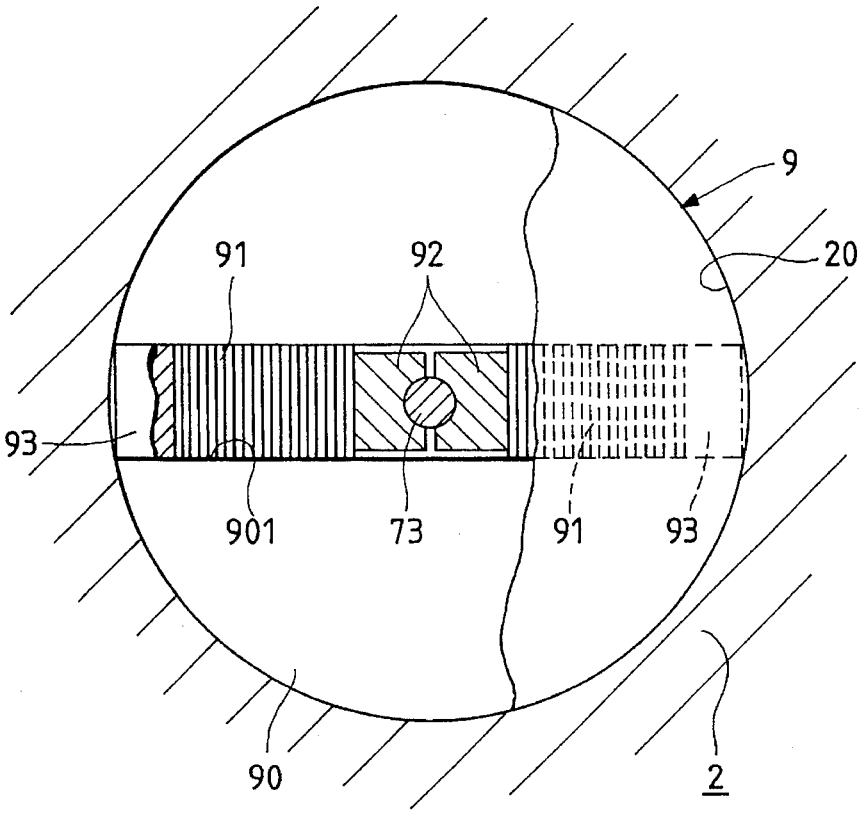
FIG. 6 is a transverse partial cutaway view showing the braking means shown in FIG. 5.

The disc-like casing 90 has, as shown in FIG. 5, a vertical hole 900 whose diameter is large enough to make the small-diameter portion 73 of the spool valve 7 axially movable and a lateral hole 901 made perpendicular to the vertical hole 900.

The press plates 92 are arranged for the lateral hole 901 in such a manner as to face the small-diameter portion 73 of the spool valve 7, whereas the laminated piezoelectric elements 91 are each arranged in the rear of the press plates 92. Further, plugs 93 for positioning and pressurizing the laminated piezoelectric elements 91 are fitted to the respective ends of the lateral hole 901 by any one of the techniques such as press-fitting and screwing.

Power supply lines 910 with respect to the laminated piezoelectric elements 91 are led out from the head cover 2 via the respective plugs or otherwise led out via the stopper 11 as shown in the drawing before being connected to the output of an external controller 12.

A spring pedestal 13 is axially movably fitted into the large-diameter hole 110 of the stopper 11, and the small-diameter portion 73 of the spool valve passing through the vertical hole 900 of the disc-like casing 90 is securely fitted to the spring pedestal 13. The spring 8 is held between the spring pedestal 13 and the base of the small-diameter hole 111 and used to press the spool valve 7 downward via the spring pedestal 13. It is needed for the spring 8 to be set so that it can exert force for allowing the valve portion 70 to reach the ascent position at the time of injection and allowing it to reach the descent position at the time of non-injection under any injecting condition.

There is formed a gap c for regulating the stroke of the spool valve 7 between the surface of the spring pedestal 13 and the base of the large-diameter hole 110. The gap c is so dimensioned as to make the annular groove 760 communicate with the upper injection hole group 34 in such a state that the valve portion 70 of the spool valve 7 has reached the ascent position.

For gap adjusting purposes, further, a collar 114 is fitted to the outer periphery of the stopper 11, and an adjusting shim 16 having a desired thickness is placed between the underside of the collar 114 and the surface of the head cover. Fixing screws 115 passing through the collar 114 are then used for tightening the head cover.

The position sensor 14 is a means for detecting the axially-directed positions (ascent and descent positions) of the spool valve 7 and fitted into the fitting hole 112 with a holder portion and besides a conductor is connected to the input of the controller 12.

The position sensor 14 may be of either non-contact or contact type. Representative examples of the former and the latter are a contactless switch and a contact switch, respectively. The detecting portion 140 of the position sensor 14 faces the small-diameter hole 113, and a shaft portion 131 extending from the center of the surface of the spring pedestal 13 is slidably fitted into the small-diameter hole 113.

An axial position signal of the valve portion is input to the input of the controller 12 from the position sensor 14 and any other signal is also input thereto from sensors indicating the operating condition of the engine. Such sensors include a sensor 17 for detecting the number of revolutions (or a rotational angle sensor) of the engine or the fuel injection pump, and a load sensor 18 such as a rack sensor for the fuel injection pump, a throttle opening sensor and the like.

Further, programs have been built up for the controller 12 according to the map formed from data on the load and the number of revolutions beforehand so as to keep the spool valve 7, for example, at the descent position by operating the braking means 9 after obtaining a signal from the position sensor 14 at the time of idling and low-speed, light-load, and to keep the spool valve 7 at the ascent position by operating the braking means 9 after obtaining a signal from the position sensor 14 at the time of high-speed, heavy-load to make the fuel passage 36 remain in a state conforming to the upper injection hole group 34.

Incidentally, the timing at which control is exerted to switch the spool valve 7 from the ascent position to the descent position is preferably fixed at the time no axially-directed force due to the pressure in the engine cylinder is applied, that is, during the intake or exhaust stroke given by the engine so as to stabilize the energizing force derived from the spring 8. The timing can thus be materialized by letting the controller 12 process the signal from the sensor 17 for detecting the number of revolutions and stopping supplying power to the braking means 9 at the predetermined timing.

Although the size of injection hole diameters has been set as the upper injection hole group>lower injection hole group according to this embodiment of the invention, this order may be reversed.

Although the fuel passage 76 has the annular groove 760 according to this embodiment of the invention, moreover, the upper and lower injection hole groups may be replaced with radial holes corresponding in number and position to the former by dispensing with the annular groove 760; this is advantageous in that the dead volume is reducible.

Although the laminated piezoelectric element 9 and the press plate 92 are made to cooperate to form a pair according to this embodiment of the invention, further, the invention is not limited to this example but may be implemented by forming two pairs in a cross mode or otherwise forming three pairs at intervals of 120°.

A description will subsequently be given of the functions of the embodiments of the present invention.

Since the spool valve 7 in the normal condition has been pressed downward by the spring 8, the valve portion 70 remains at the descent position and the fuel passage 76 in this state communicates with the lower injection hole group 35, whereas the upper injection hole group 34 is closed with the outer peripheral face of the valve portion as shown in FIG. 2A and FIG. 3.

The pressurized fuel is sent from the fuel injection pump (not shown) via the piping to the pressurized fuel port 104 and forced in the oil reservoir 301 via the passage holes 105, 305 before being made to flow down through the annular fuel passage A therefrom.

The fuel pressure simultaneously acts on the pressure receiving part 42 of the nozzle needle 4 located at the oil reservoir 301, and the nozzle needle 4 is lifted when the fuel pressure reaches the predetermined injection pressure overcoming the setting force of the nozzle spring 103. Then the seat face 44 in the lower end portion is separated from the seat face 303 of the nozzle body 3 and the valve opens. Consequently, the pressurized fuel enters the bottomed hole 304 and flows from the radial holes 74 opened to the valve portion 70 of the spool valve 7 into the internal fuel passage 75.

Simultaneously, the pressurized fuel flows into the gap between the small-diameter shaft portion 72 of the spool valve 7 and the first hole **45*a* of the nozzle needle 4 and presses the underside 710 of the intermediate large-diameter portion 71 upward; as this force is greater than that of the spring 8 in the head cover 2, the spool valve 7 is lifted until the spring pedestal 13 abuts against the base of the large-diameter hole 110 of the stopper 11, that is, until the gap c disappears while being guided by the valve portion 70, the shaft hole 304*b*, the intermediate large-diameter portion 71 and the first hole 45*a*. Thus the fuel passage 76 provided in the valve portion 70 of the spool valve 7** is caused to move axially and reaches the ascent position.

Then, the annular groove 760 mates with the upper injection hole group 34, whereas the lower injection hole group 35 is closed with the outer peripheral face of the valve portion 70. Therefore, the pressurized fuel passes from the internal fuel passage 75 through the large-diameter upper injection hole group 34 and is injected into the engine cylinder.

As the pressure of the pressurized fuel being supplied lowers, the nozzle needle 4 opens and simultaneously the lifting force applied to the underside 710 of the intermediate large-diameter portion 71 of the spool valve 7 decreases, whereby the spool valve 7 is forced downward by the force of the spring 8. Thus the valve portion 70 is returned to the descent position.

The axial movement of the spool valve 7 due to the aforementioned injection pressure is detected by the position sensor 14 in the head cover 2.

While the spool valve 7 remains at the descent position, the leading end of the shaft portion of the spring pedestal 13 is separated from the detection end 140 of the position sensor 14 as shown in FIG. 3 and when the spool valve 7 moves to the ascent position, the leading end of the shaft portion 131 of the spring pedestal is made to abut against or set extremely close to the detection end 140 of the position sensor 14.

When these two kinds of (on/off) signals are sent to a controller 14, the axial position of the valve portion 70 is determined, that is, whether the fuel passage 76 is located at the upper or lower injection hole position can be determined.

On the other hand, signals for indicating the load and the number of revolutions (or angle of rotation) of the engine or the fuel injection pump are continuously applied to the controller 12 from the sensors 18 and 17. The controller 12 processes the data on the position of the valve portion 70 and the load or the number of revolutions and causes power to be supplied to the braking means 9 selectively, whereby the spool valve 7 is forced to stay at either upper or lower injection hole position. Thus the fuel is injected from the injection holes different in diameter.

In other words, the signal from the controller 12 causes power to be supplied to the pair of laminated piezoelectric elements 91 when the valve portion 70 is determined by the signal from the position sensor 14 to be at the descent position in the case where the engine remains in the low-speed, light-load condition. Thus the laminated piezoelectric elements 91 are deformed in the direction around which they center within the lateral hole 901, whereby the press plates 92 advance so as to contact the outer periphery of the small-diameter portion 73 of the spool valve 7. Even when the lifting force derived from the injection pressure acts on the underside 710 of the intermediate large-diameter portion 71 as described above, the frictional force due to the press plates 92 prevents the spool valve 7 from moving in the axial direction and keeps it at the descent position.

Therefore, the fuel passage 76 of the valve portion 70 is held in such a state that it communicates with the lower injection hole group 35 as shown in FIG. 2A and FIG. 3. Since each injection hole 350 in the lower injection hole group 35 has a small-diameter, the fuel is highly pressurized and dischargeable for a good length of time. Moreover, the fuel is atomized and becomes fit for circumferential atomization. Therefore, an adequate fuel-air mixture is produced, which decreases percentage in delaying ignition and results in reducing NOx.

While the engine is in the high-speed, heavy-load state, on the other hand, the signal from the controller 12 stops supplying power to the pair of laminated piezoelectric elements 91 of the braking means 9. Thus the deformation of the laminated piezoelectric elements is released and allowed to restore their original thickness. Then the press plates 92 cease to move and the spool valve 7 is allowed to move axially and besides the injection pressure applied to the underside 710 of the intermediate large-diameter portion 71 causes the spool valve 7 to lift off instantly, whereby the valve portion 70 moves to the ascent position.

When the movement of the valve portion 70 is confirmed by the position sensor 14, the controller 12 issues the signal for supplying power to the pair of laminated piezoelectric elements 91 of the braking means 9. Thus the laminated piezoelectric elements 91 are deformed and the spool valve 7 is gripped by the press plates 92. Then the valve portion 70 is held at the ascent position, irrespective of the on/off of the nozzle needle 4.

Consequently, the fuel passage 76 is kept communicating with the upper injection hole group 34 as shown in FIG. 2B and FIG. 4 and since the injection holes 340 in the lower injection hole group 34 are relatively greater in diameter than those 350 in the lower injection hole group 35, a large amount of fuel is injected into the cylinder for a short period in conformity with the engine condition. Then, combustion is effected at a stable, high output, so that smoke becomes reducible. Incidentally, it is preferred for the upper injection hole group to execute fuel injection even when the engine is started.

In the state that the engine is restored to the low-speed, light-load condition again, the braking means 9 operates to stop supplying power and subsequently allows supplying power again when it is confirmed by the position sensor 14 that the valve portion 70 stays at the descent position. Control of switching the upper injection hole group to the lower injection hole group like this is preferably exerted during the intake or exhaust stroke given by the engine, which is determined by the signal indicative of the number of revolutions or the angle of rotation of the engine from the sensor 17.

While the valve portion 70 is contained in the bottomed hole 304, it is actuated in any injecting condition and is less affected directly by the axial force derived from the pressure in the engine cylinder, so that it is less affected by heat originating from the combustion chamber of the engine. It is therefore ensured that the axial movement of the valve portion is smoothly made and set free from seizing.

While no power is supplied to the braking means 9, fuel is injected by small-diameter and large-diameter injection holes by means of the fuel pressure. In other words, the small-diameter injection holes in the lower injection hole group 35 are first used when the fuel pressure causes the nozzle needle 4 to lift and subsequently the large-diameter injection holes in the upper injection hole group 34 are actuated when the spool valve 7 is lifted. This operation is repeated in accordance with the crank angle.

As was described above, according to the invention, the plurality of injection hole groups 34 and 35 are provided at axially different circumferential levels in the side wall of the bottomed hole 304 formed in the leading end portion of the nozzle body 3, the injection holes in the injection hole groups 34 and 35 at different circumferential levels being different in diameter from each other. The valve portion 70 of the spool valve 7 passed through the axial center of the nozzle needle 4 is positioned in the bottomed hole 304, and the spool valve 7 is urged downward by the spring 8 on the upper side so that the lower end of the valve portion abuts against the base of the bottomed hole in the normal condition and that the valve portion is axially displaced by the pressure of the pressurized fuel. The fuel passage 76 is provided in the valve portion 70 at such a level that it communicates with the one injection hole group 34 at the descent potion, whereas it communicates with the other injection hole group 35 at the ascent position. Moreover, the braking means 9 provided on the upper side is used to fixedly hold both the axial positions of the spool valve 7, depending on the operating condition of the engine. Therefore, the freedom of setting the injection holes is extremely increased, whereby fuel can be injected with plurality of hole-diameter variations under the control of the braking means 9. Therefore, the present invention has the excellent effect of reducing not only NOx at the time of light load but also smoke at the time of heavy load. Moreover, the valve portion 70 of the spool valve 7 is contained in the bottomed hole 304, and its axial displacement is less affected by the pressure in the engine cylinder. Consequently, the braking means 9 can be small-sized and made free from malfunctioning due to seizing with the effect of making controllable the individual fuel injection using the plurality of injection hole groups.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A variable injection hole type fuel injection nozzle, comprising:

a nozzle needle having a seat portion;

a nozzle body into which said nozzle needle is inserted, said nozzle body having a bottomed hole for guiding pressurized fuel to a leading end portion of said nozzle needle below the seat portion of said nozzle needle, and at least first and second injection hole groups at axially different first and second positions in a side wall of the bottomed hole, respectively, said first injection hole group having a plurality of injection holes being different in diameter from those of said second injection hole group;

a spring;

a spool valve having a valve portion which passes through an axial center of said nozzle needle and a leading end portion fitted into the bottomed hole of said nozzle body, said valve portion being urged by said spring so that a lower end of said valve portion abuts against a base of said bottomed hole in a normal condition, said valve portion defining a fuel passage therein, said fuel passage communicating with said first injection hole groups in the normal condition and communicating with said second injection hole group at a position where said valve portion is displaced axially against a force of said spring on receiving the pressure of the pressurized fuel; and braking means arranged in an upper region of said spool valve for selectively securely holding said valve portion of said spool valve at one of said first and second positions.

2. A variable injection hole type fuel injection nozzle according to claim 1, further comprising:

sensor means for detecting operating conditions of an engine to output a detection signal representative of a detection result; and control means for controlling said braking means according to the detection signal from said sensor means.

3. A variable injection hole type fuel injection nozzle according to claim 1, wherein said braking means comprises means for allowing said spool valve to axially move during non-operation and for forcibly hold said spool valve at one of said first and second positions during operation.

4. A variable injection hole type fuel injection nozzle according to claim 3, wherein said braking means is of a piezoelectric actuator type.

5. A variable injection hole type fuel injection nozzle according to claim 3, wherein said braking means is of an electromagnet type.

6. A variable injection hole type fuel injection nozzle according to claim 2, wherein said sensor means comprises a sensor for detecting the number of revolutions of one of the engine and a fuel injection pump, a load sensor and a position sensor for detecting the axial position of said valve portion of said spool valve.

7. A variable injection hole fuel injection nozzle according to claim 2, wherein said first and second injection hole groups at said first and second positions have large-diameter injection holes and small-diameter injection holes, respectively; and wherein when said control means judges that the engine is in a high-speed, heavy-load state on the basis of the detection signal from said sensor means, said control means allows said braking means to hold said valve portion of said spool valve to said first position, and when said control means judges that the engine is in a low-speed, light-load condition on the basis of the detection signal from said sensor means, said control means allows said braking means to hold said valve portion of said spool valve to said second position.

* * * * *